United States Patent [19]

Gronert

[11] 3,949,516

[45] Apr. 13, 1976

[54] TOY BUILDING ASSEMBLY

[76] Inventor: Ronald Gronert, 76 Willem de Rijkelaan, Hillegom, Netherlands

[22] Filed: Aug. 6, 1974

[21] Appl. No.: 495,170

[30] Foreign Application Priority Data

Aug. 27, 1973 Netherlands ..... 7311744

[52] U.S. Cl. ..... 46/17; 46/12; 46/43

[51] Int. Cl.[2] ..... A63H 33/06

[58] Field of Search ..... 46/17, 20, 21, 19, 30, 46/31, 12, 43, 25

[56] References Cited

UNITED STATES PATENTS

| | | | |
|---|---|---|---|
| 311,793 | 2/1885 | Stranders | 46/19 UX |
| 2,855,206 | 10/1958 | Haviland | 46/25 X |
| 3,002,315 | 10/1961 | Kuhn | 46/31 X |
| 3,070,234 | 12/1962 | Deitchman | 46/30 X |
| 3,225,487 | 12/1965 | Mallalieu | 46/17 |
| 3,636,230 | 1/1972 | Lacey | 46/31 |
| 3,653,146 | 4/1972 | Goldfarb | 46/17 |

*Primary Examiner*—F. Barry Shay

*Attorney, Agent, or Firm*—Ladas, Parry, Von Gehr, Goldsmith & Deschamps

[57] ABSTRACT

A toy building assembly system to form toy parking garages for playing with toy vehicles. The toy is assembled by stacking column elements. Each column element has a depending bottom flange and a recessed upper edge, and between the bottom flange and the upper edge of successive column elements a substantially vertical peripheral gap is formed to receive upstanding flanges on floor elements and ramps which are to be mounted on the column elements.

4 Claims, 8 Drawing Figures

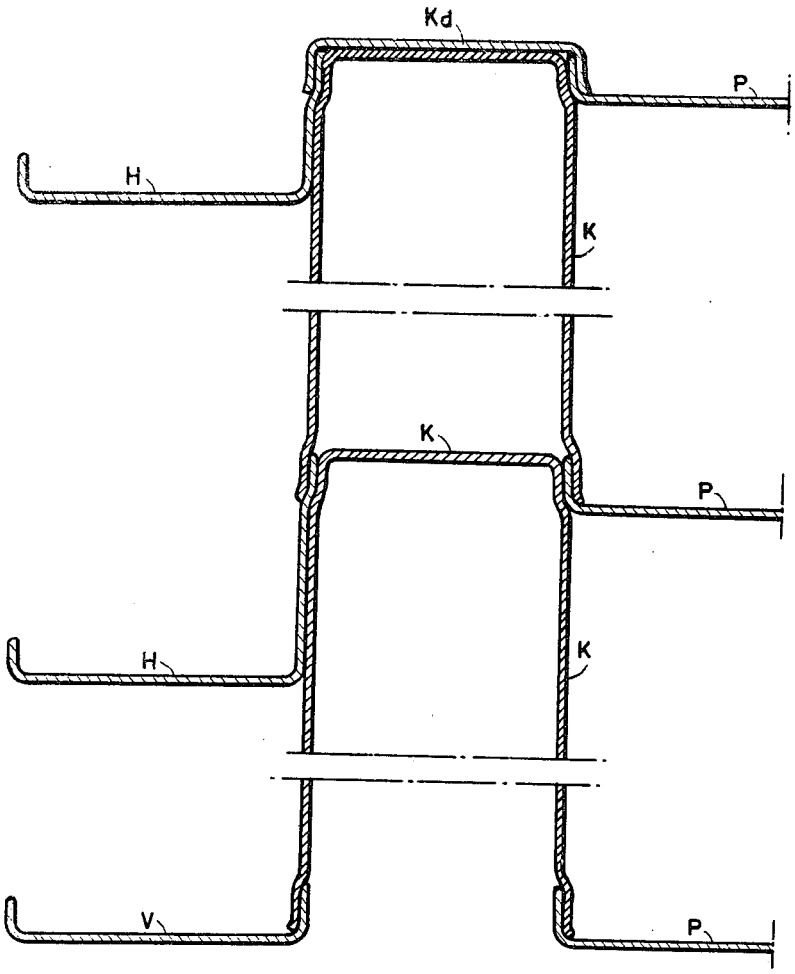
FIG. 4
FIG. 5
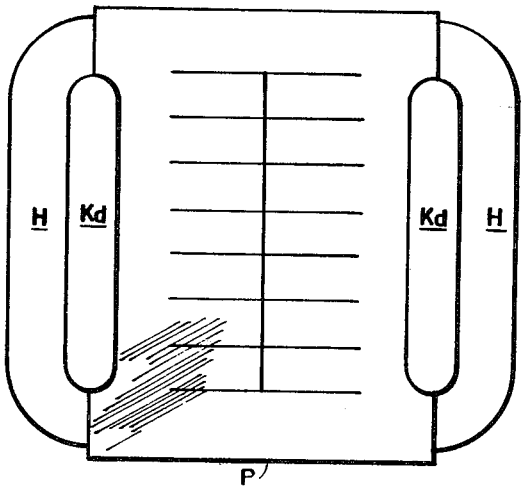

FIG.6
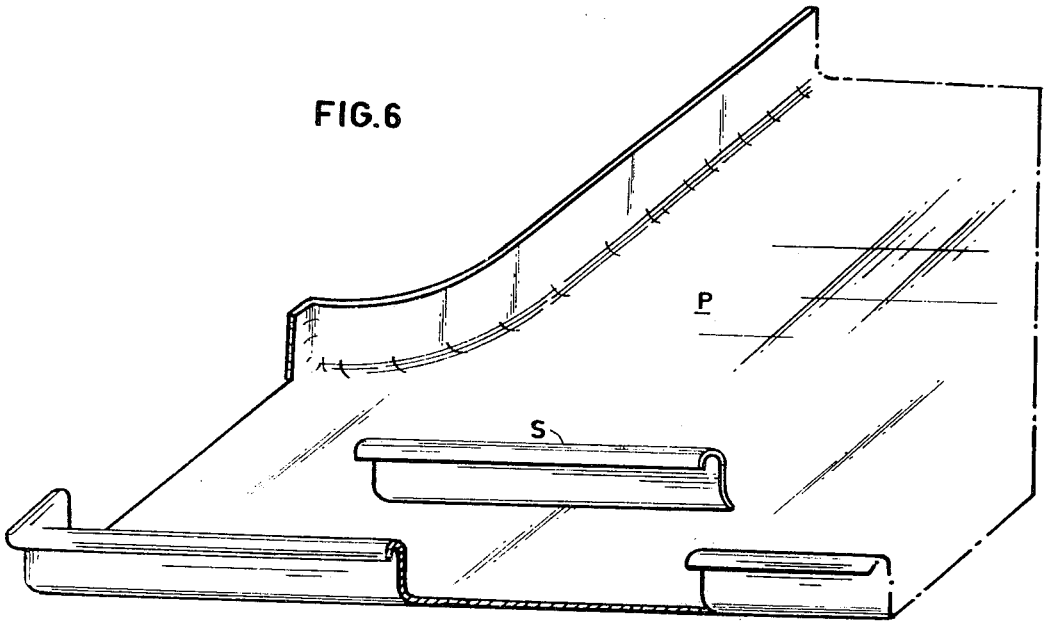
FIG.7
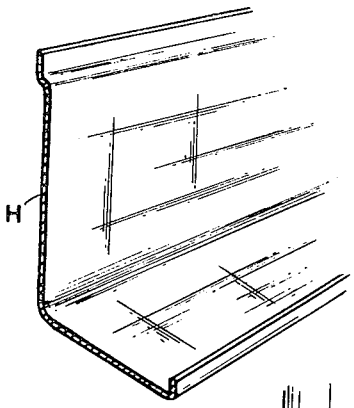
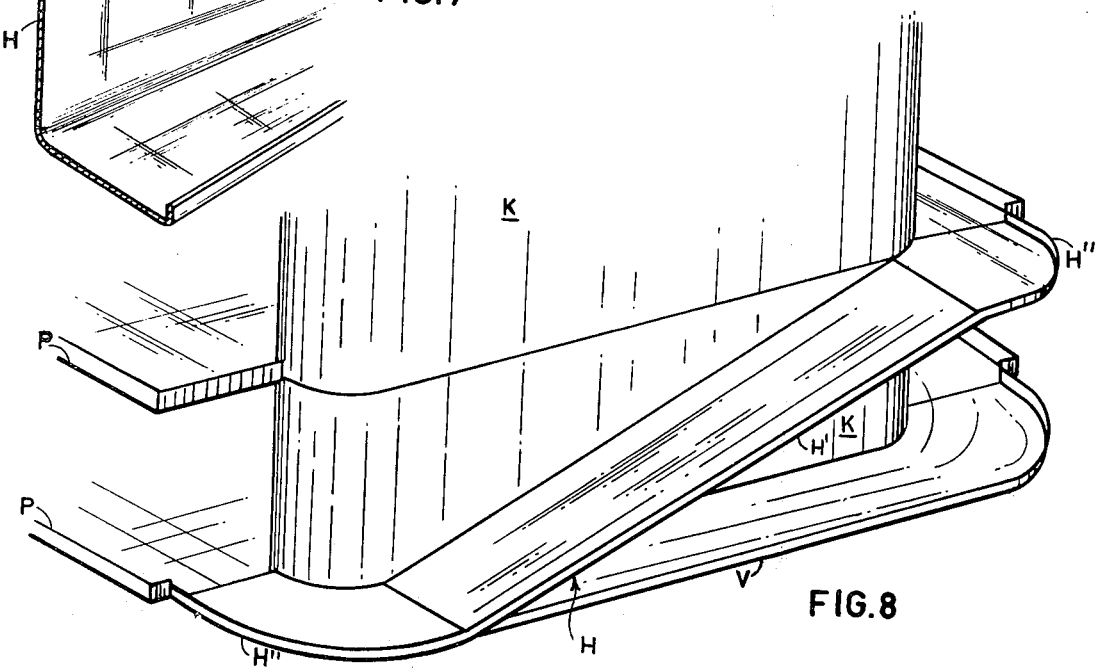
FIG.8

TOY BUILDING ASSEMBLY

BACKGROUND OF THE INVENTION

This invention relates to an assembly system for a toy building, and particularly a toy parking garage having ramps, which toy is adapted to be enlarged in height and in width. Such a toy is disclosed in U.S. Pat. No. 3,653,146.

SUMMARY OF THE INVENTION

The present invention provides for a quick and efficient assembly of the building elements such as the floors, columns, and ramps of a toy parking garage in stacked relationship, and is characterized by a mounting element consisting of a column element which has a depending jacket at its bottom, and an upper surface provided with a recessed edge to form a support ledge for floor elements and ramps which are to be mounted on said column element, and said edge receiving around it the depending jacket of a subsequent column element which is stacked, while leaving a substantially vertical peripheral gap therebetween, wherein upstanding flanged edges which are provided at the circumference of the floor elements and ramps, are to be retained.

The building which is erected by means of such mounting elements, is to be completed by a cover lid having a jacket which is to be fitted about the upstanding flanged edges of the floor elements and/or ramps on the uppermost column element.

The preferred embodiment is characterized in that the column element has a horizontal section in the shape of an elongated rectangle having semicircular ends, and by an elongated straight ramp having quart-circular connections to the adjacent floor elements, which ramp is to be closely fitted onto the outer half of a column element.

By means of the described mounting element which has a protruding jacket at its bottom and a peripheral recess at its top, which leave a vertical peripheral gap in successive elements for flanges to be inserted, a child can easily build the parking garage according to its own imagination.

The invention is described more in detail in the following specification with reference to the drawings which show an example thereof.

BRIEF DESCRIPTION OF THE DRAWINGS

FIG. 4 is a sectional view on a larger scale of the mounting elements in stacked relationship.

FIG. 5 is a plan view on a reduced scale of the parking garage.

FIG. 6 shows a floor detail, to the same scale as FIG. 4.

FIG. 7 shows, on a two times smaller scale as in FIGS. 4 and 6, a ramp detail at the location indicated by the arrows in FIG. 8.

FIG. 8 is a perspective view on a smaller scale as in FIG. 7 of a ramp which is mounted on a column stack.

DESCRIPTION OF THE PREFERRED EMBODIMENT

Figure 1:
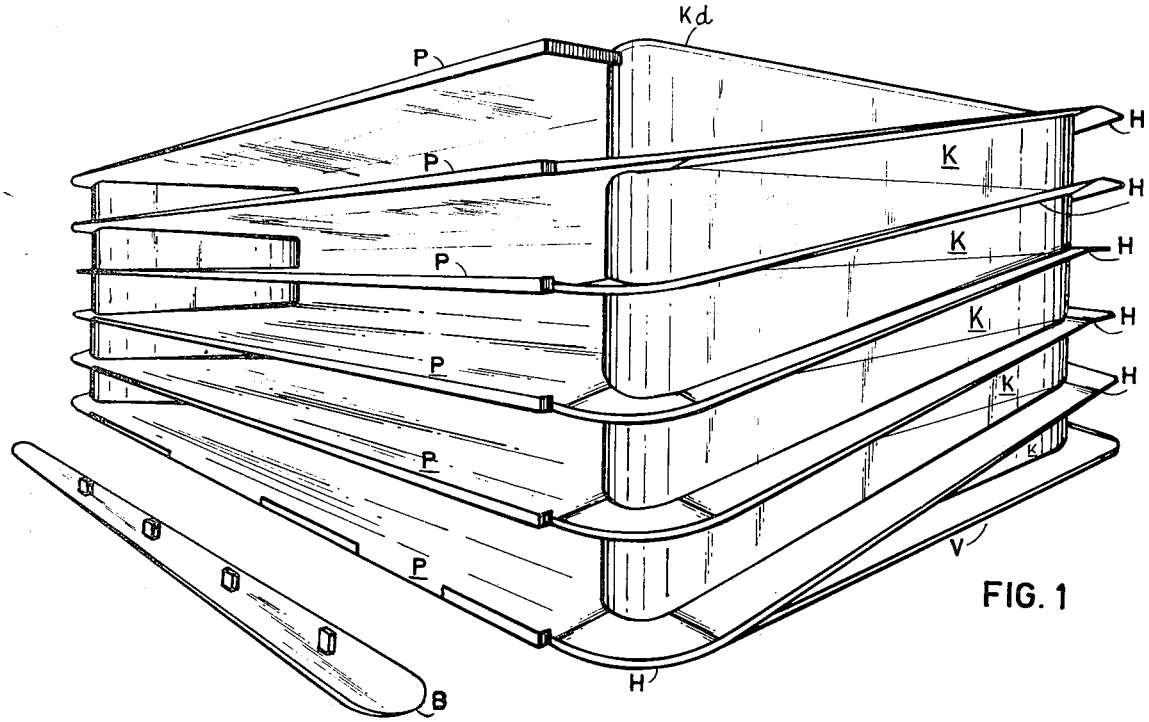
FIG. 1 is a perspective view of a six-floor toy parking garage and shows the most essential parts thereof.
Figure 2:
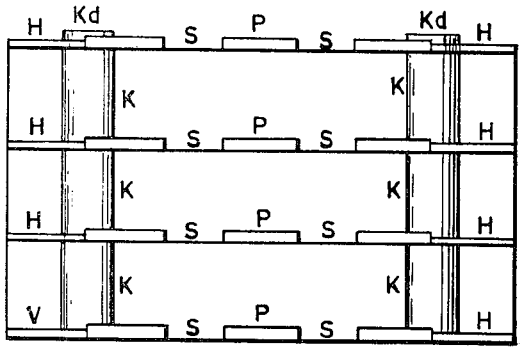
FIGS. 2 and 3 show a front view and a side view respectively, on a reduced scale, of a toy parking garage which is similar to that of FIG. 1 except that it has only four floors.
Figure 3:
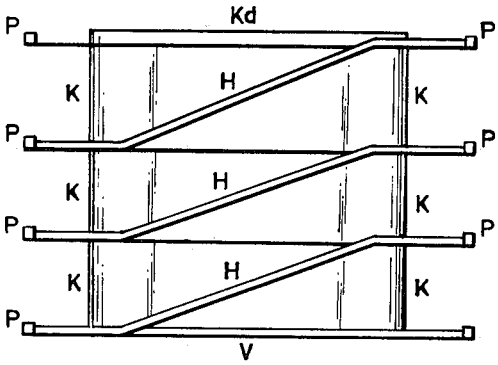

The toy parking garage, as shown in the drawings, is constructed of parking floors P and ramps H which are mounted on the columns K, said columns functioning as mounting elements. It can be seen from the drawings, particularly FIGS. 5 and 7, that each ramp H comprises an inclined plane portion H′ and two quartercircular connection portions H″ at the upper and lower ends respectively of the inclined plane portion H′. Also, each parking floor P is of generally retangular shape but has cut out of its two long sides a rectangular portion terminated at each end by a quarter-circular curve.

As is illustrated in FIG. 4, each column K has a depending jacket in the form of a protruding peripheral flange at the bottom, and around the upper surface thereof a recessed edge is provided, which forms a support ledge for floor elements P and ramps H which are to be mounted on a column element K, and around said edge the depending peripheral flange or jacket of a subsequent column element K is to be received, while leaving a substantially vertical peripheral gap therebetween, wherein upstanding support flange edges which are provided at the circumference of the floor elements P and ramps H, are to be fitted.

The top of the column is closed by an element in the form of a column cap Kd which functions to interconnect the parts of the upper storey. From FIG. 5 it is apparent that the column caps Kd not only function as the final connection, but also as a finishing of the column. The cap Kd consists of a cover lid having a jacket which is to be fitted about the upstanding flanged edges of the floor elements P and ramps H of the uppermost column element K.

A floor strip V is laid under the parking garage, as is shown in FIG. 1, which supports the columns K at the outer side, and a gas station B is arranged in front of the garage. The floor strip V is straight but is terminated at one end by a quarter-circular curved portion.

In FIG. 6 is illustrated that removable sliding doors S are provided in the upstanding edge of the parking floors P. When the sliding doors are closed, the edge of the parking floors P is blocked.

From FIG. 7 it is apparent that the ramps H are of such a shape that when the ramp is mounted onto a column element K, in the manner as illustrated in FIG. 4, a close fitting building unit is formed. In FIG. 8 is shown that the ramp H consists of an elongated straight slope having quart-circular connections to the adjacent floor elements P, and is to be closely fitted onto the outer half of a column element K which has a horizontal section in the shape of an elongated rectangle with semicircular ends. From FIG. 8 it is clearly apparent that when the ramps H are mounted on the column elements K, a rigidly connected unit is formed, which is supported by the floor strip V.

The toy parking garage is readily to be assembled and to be disassembled and offers many possibilities for enlargement so as to allow playing children to develop their initiative.

What is claimed is:

1. A toy parking garage comprising:

a plurality of ramps each having an inclined plane portion and a support flange which extends upwardly from one side of the inclined plane portion and has a horizontal upper edge;

a plurality of horizontal floor elements each provided with upstanding support flanges extending along opposed edges thereof; and a plurality of stackable column elements for supporting the ramps and floor elements, each said column element including means for detachably connecting it in stacked relation with others of said column elements and for detachably attaching said floor elements and ramps to said column elements, said means comprising an upper edge recess surrounding the upper surface of said column element providing a support ledge for said support flanges, and a jacket at the bottom of said column element of a size to fit over the upper edge of a lower column element while leaving a vertical clearance between said jacket and the upper edge of said lower column element to retain the support flange of a floor element or ramp supported on the support ledge of said lower column element.

2. A toy parking garage as claimed in claim 1, further comprising a cover lid which can be fitted over a column element, the cover lid having a jacket which fits over the upper edge of the column element while leaving a vertical clearance between the jacket and the upper edge of the column element to secure the flange of a floor element or ramp supported on the support ledge of the column element.

3. A toy parking garage as claimed in claim 1, wherein each column element has, in horizontal section, the shape of an elongated rectangle having semicircular ends.

4. A toy parking garage as claimed in claim 3, wherein the clearance between the jacket of an upper column element and the upper edge of a lower column element extends along both sides of the rectangular cross-section of the column elements, a first said floor element has its flange positioned inside the jacket along one of said long sides of the lower column element, a second said floor element has its flange received in the clearance along said one long side of the upper column element, and a said ramp joining said first and second floor elements has its flange received in the clearance along the other of said long sides of the upper column element and has, at the ends of its inclined plane portion, quarter-circular connection portions connecting the inclined plane portion to the first and second floor elements respectively.

* * * * *